US005242064A

United States Patent [19]

Martell

[11] Patent Number: 5,242,064

[45] Date of Patent: Sep. 7, 1993

[54] COMBINATION SELF-DRAINING SOAP HOLDER AND UTILITY SHELF

[76] Inventor: Steve Martell, 12201 S. Oglesby, Chicago, Ill. 60633

[21] Appl. No.: 992,567

[22] Filed: Dec. 18, 1992

Related U.S. Application Data

[63] Continuation-in-part of Ser. No. 814,104, Dec. 26, 1991, abandoned.

[51] Int. Cl.[5] ..... A47F 7/00

[52] U.S. Cl. ..... 211/87; 211/90; D6/532; 206/77.1

[58] Field of Search ..... 211/87, 13, 90; 206/77.1; D6/532, 533, 536, 540

[56] References Cited

U.S. PATENT DOCUMENTS

| | | | |
|---|---|---|---|
| D. 72,691 | 5/1927 | Balmer | D6/532 |
| D. 165,532 | 12/1951 | Lind . | |
| D. 188,453 | 7/1960 | Marcus | D6/532 |
| D. 266,123 | 9/1982 | Alfano . | |
| D. 283,282 | 4/1986 | Haske . | |
| D. 286,237 | 10/1986 | Muderlak . | |
| D. 288,510 | 3/1987 | Shames et al. . | |
| 1,536,906 | 5/1925 | Miller . | |
| 2,067,591 | 1/1937 | Balmer . | |
| 2,175,753 | 10/1939 | Guthmann | D6/540 X |
| 3,233,744 | 2/1966 | Ripps . | |
| 3,323,850 | 6/1967 | Link . | |
| 4,300,248 | 11/1981 | Dworkin . | |
| 4,548,340 | 10/1985 | Messer . | |
| 4,548,572 | 10/1985 | Hoffman | 206/77.1 X |
| 4,621,730 | 11/1986 | Mancusi, Jr. . | |
| 4,709,428 | 12/1987 | Garcia . | |
| 4,993,546 | 2/1991 | Southard | 206/77.1 |

*Primary Examiner*—Robert W. Gibson, Jr.

*Attorney, Agent, or Firm*—McAndrews, Held & Malloy, Ltd.

[57] ABSTRACT

A combination soap holder and utility shelf includes a series of ribs and spaces which drain excess water and residue thereby making it easy to grasp and retrieve soap and other bath articles even when wet. The soap-holder ribs slope first downward and then sharply upwards away from the back of the soap holder to hold the soap securely while allowing the soap to be easily grasped and retrieved in a single continuous motion without being lifted. In alternative embodiments, the combination soap holder and utility shelf may be recessed into, molded integrally with, or flush-mounted to a conventional bath or shower enclosure. An embodiment for deep walls allows the soap holder to protrude farther into the wall, making it possible to have a profile that is more nearly flush with the wall. Any of the embodiments may have ribs connected to a platform or tray that is removable for cleaning.

16 Claims, 8 Drawing Sheets

Fig. 8
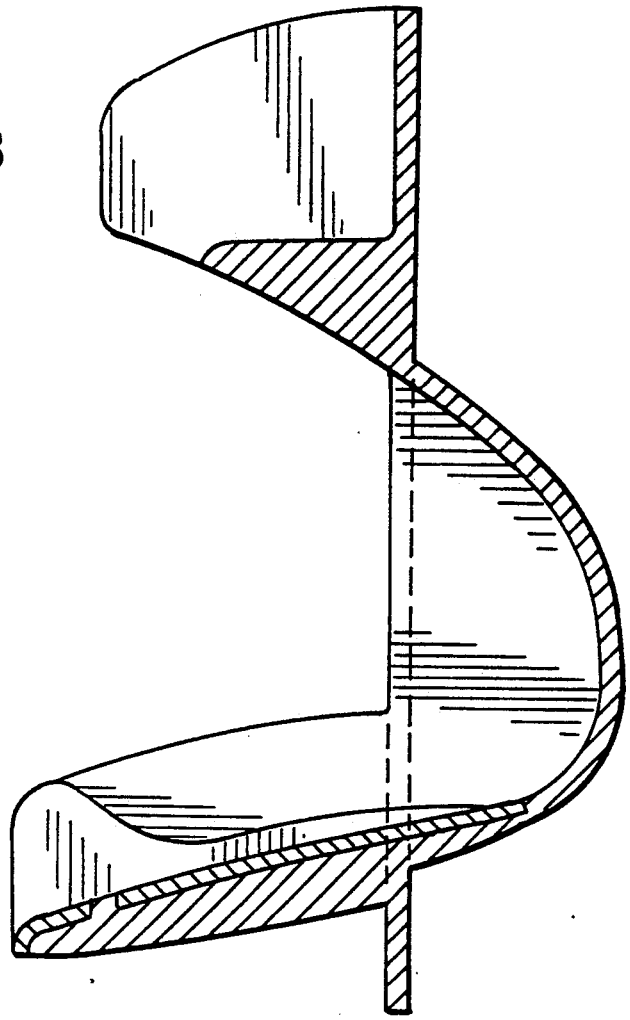
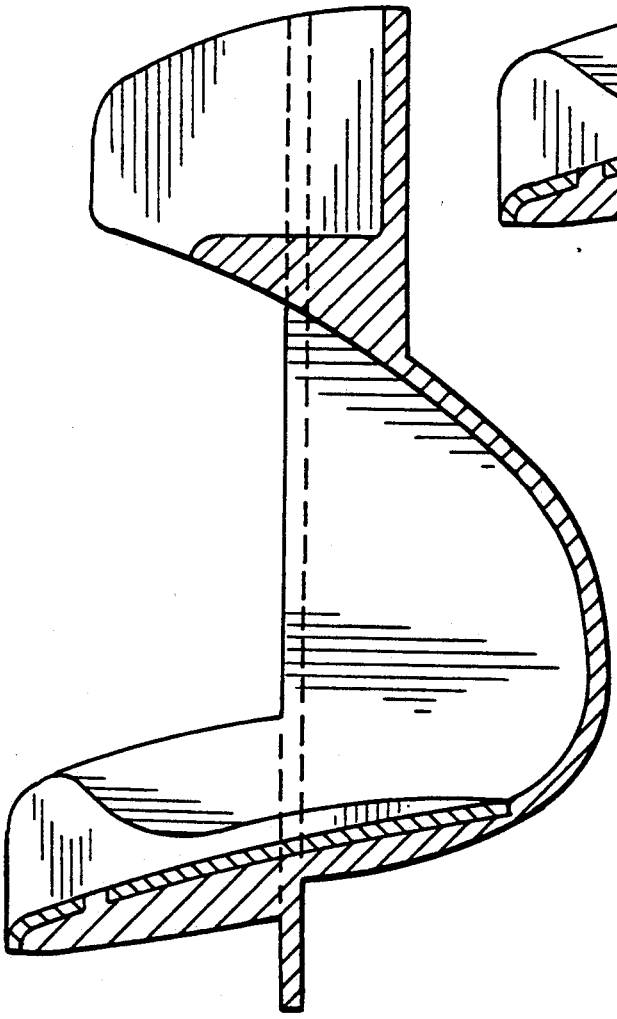
Fig. 9

COMBINATION SELF-DRAINING SOAP HOLDER AND UTILITY SHELF

CROSS-REFERENCES TO RELATED APPLICATIONS

This application is a continuation in part of application Ser. No. 07/814,104, filed Dec. 26, 1991, now abandoned.

BACKGROUND OF THE INVENTION

This invention relates to bath fixtures and more particularly to a combination soap holder and utility shelf designed to permit drainage and to provide a convenient means of storing, protecting and retrieving soap and other bath articles.

Bathing facilities are generally equipped with a ceramic, metal or plastic soap-holding fixture affixed to or recessed into the bath enclosure comprising a tray for holding a bar of soap and a U-shaped support commonly referred to as a grab bar. The soap holder typically collects and retains water spray or splash which causes the soap to soften and to become difficult or undesirable to use. Additionally, the front edge of the soap holder routinely includes a lip which makes the soap awkward to grasp and retrieve when wet. The U-shaped support is intended to be used as an emergency handhold or to suspend a washcloth, but, in practice is sometimes used to support supplementary bath articles such as shampoo, razors and sponges. Bath accessories are also oftentimes stored in other dangerous, inconvenient and unsightly locations such as the floor of the shower or edges of the bathtub.

A number of prior art devices have been developed to protect and conserve soap from the softening effects of standing water. Miller U.S. Pat. No. 1,536,906, issued May 5, 1925, untitled, discloses a recessed soap dish comprising a plurality of coplanar ribs to support a bar of soap and formed with a gutter to allow water to drain back into the sink. However, the '906 patented device has a lip and side and back walls which make it difficult to easily grasp and retrieve a wet bar of soap. Additionally, the effectiveness of the Miller soap dish to drain excess water and soap residue is limited when soap residue collects between the ribs, the floor of the soap dish and the bottom surface of the soap. Further, the soap dish described by the '906 patent is designed for use with a sink or sink back and is not intended for use with a conventional bathtub, shower, or bathtub-shower enclosure.

Dworkin U.S. Pat. No. 4,300,248, issued Nov. 17, 1981, entitled SNAP-IN SOAP DISH LINER FOR BATHROOM FIXTURES, discloses a soap dish liner designed to snap into a bathroom fixture. The liner includes means for draining excess water away from the soap into the soap holder. However, the patented device allows water and soap residue to collect in the soap dish and must be disengaged to be cleaned. Additionally, because the liner extends beyond the side walls and ceiling of the soap dish, it is difficult to grasp and retrieve a wet bar of soap.

Mancusi, Jr. U.S. Pat. No. 4,621,730, issued Nov. 11, 1986, entitled AERATED SOAPHOLDER, discloses a soap holder comprising a pair of soap-supporting ribs projecting forward from the back wall and upwards from the floor. The side walls and floor of the soap holder flare away from the back wall at angles greater than 90 degrees. Further, the soap-contacting surfaces of the ribs protruding from the floor are sloped upward away from the back wall. However, because the '730 patented device utilizes only a single pair of supporting ribs, it cannot adequately support a bar of soap of atypical size and shape. In addition, because the soap is intended to rest against the supporting ribs along the back wall of the soap holder in close proximity to the side walls, it is difficult to grasp and retrieve a wet bar of soap.

Prior art devices have likewise been developed to store and protect additional bath articles such as shampoo, razors and sponges. Ripps U.S. Pat. No. 3,233,744, issued Feb. 8, 1966, entitled UTILITY SHELF, discloses a shelf to be mounted on a conventional bathroom soap holder for holding bath accessories. The shelf rests on the U-shaped support of the soap holder on legs which extend downward from the base. The shelf is restrained from pivoting around the U-shaped support by a tongue extending under the ceiling of the soap holder and by contact with the vertical face of the wall on which the soap holder is mounted. However, the utility shelf described in the '744 patent must be custom-fitted to match each bath fixture design and, as disclosed, requires the bath fixture to include a U-shaped grab bar. Further, although at least one embodiment of the patented device includes a means for draining excess water from the shelf, the drainage unavoidably collects in the soap holder. Most importantly, the '744 utility shelf entirely obstructs the U-shaped grab bar so that it is unavailable for emergency use.

Muderlak U.S Pat. No. Des. 286,237, issued Oct. 21, 1986, entitled COMBINED ACCESSORY HOLDER AND GRAB BAR UNIT FOR A TUB AND SHOWER, discloses a combination utility shelf, soap holder and grab bar bath fixture. However, the '237 accessory holder and grab bar unit does not provide drainage for the soap and bath articles, does not facilitate easy retrieval of a wet bar of soap and is difficult to clean.

SUMMARY OF THE INVENTION

An object of this invention is to provide a combination soap holder and utility shelf.

Another object of this invention is to provide a combination soap holder and utility shelf designed to drain excess water and soap residue from soap and bath accessories.

Another object of this invention is to provide a soap holder shaped for rapid and effortless retrieval of a wet bar of soap.

Another object of this invention is to provide a soap holder shaped to retain a bar of soap in a secure position after use.

Another object of this invention is to provide a combination soap holder and utility shelf which may be 1) recessed into, 2) integrally molded with, or 3) flush-mounted to a conventional bathtub, shower or bathtub-shower enclosure.

Other objects will become apparent in the course of a detailed description of the invention.

A soap holder and utility shelf are combined to furnish a safe, convenient and organized place to store and protect soap and bath articles such as shampoo, razors and sponges. The combination bath fixture may be made of any number of materials, including but not limited to ceramic, metal, plastic and fiberglass. In the preferred embodiment, the utility shelf is located above the soap holder and both comprise ribs which permit excess water and soap residue to drain to the floor of the bathing facility. The soap and bath article supporting surfaces may be flat, convex or any combination thereof to provide the optimum degree of contact and drainage.

The soap holder is shaped to allow a user to remove a bar of soap in an outward direction without first lifting the soap. The shape of the soap holder also retains the soap in a position well forward of the back wall to permit a user to easily grasp and retrieve, and later to replace, a wet bar of soap.

In the preferred embodiment, the soap holder and utility shelf combination is recessed into the wall of a conventional bathtub, shower or bathtub-shower enclosure. In an alternate embodiment, the combination bath fixture may be integrally molded of the same or different material as the bathtub, shower or bathtub-shower enclosure. In yet another embodiment, the invention may be flush-mounted and secured with adhesive, cement, or screws to the bathtub, shower or bathtub-shower wall. When the invention is used in a wall that is deeper than the standard wall that is sized to the width of two-by-four lumber, it may be recessed more deeply to provide a slimmer profile. Other embodiments may be devised by including a standard U-shaped grab bar in any of the previously described embodiments. A portion of the soap holder may be made removable for easier cleaning.

BRIEF DESCRIPTION OF THE DRAWINGS

FIG. 8 is a sectional side view of the embodiment of FIG. 7 taken along section lines 8—8 of FIG. 7.

FIG. 9 is an alternate sectional side view of the embodiment of FIG. 7 that is designed for deeper installation in a wall.

DETAILED DESCRIPTION OF THE INVENTION

Figure 1:
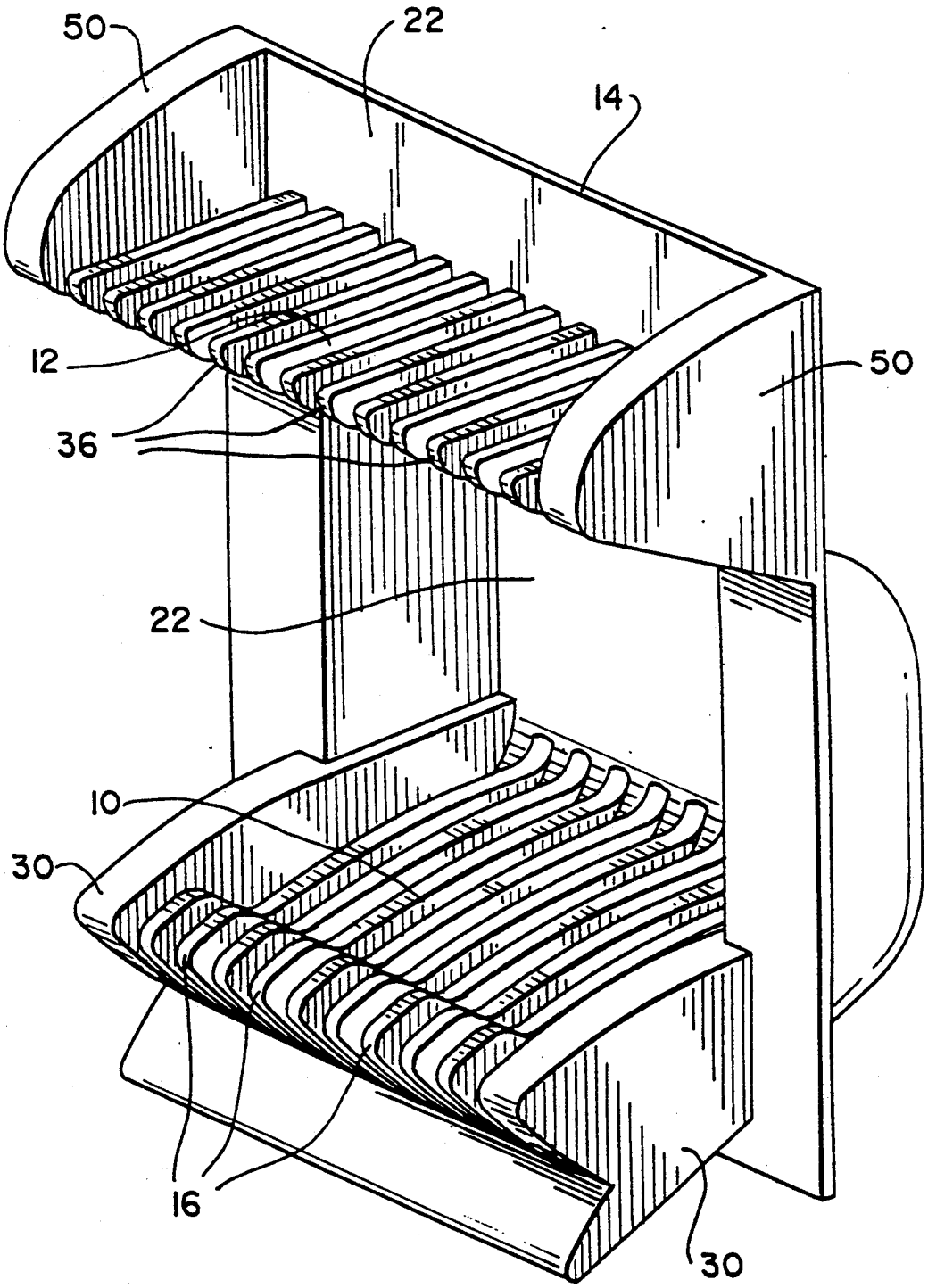
FIG. 1 is a perspective view of the preferred embodiment of the invention showing the combination soap holder and utility shelf in a conventional recessed bath fixture, configuration.
Figure 2:
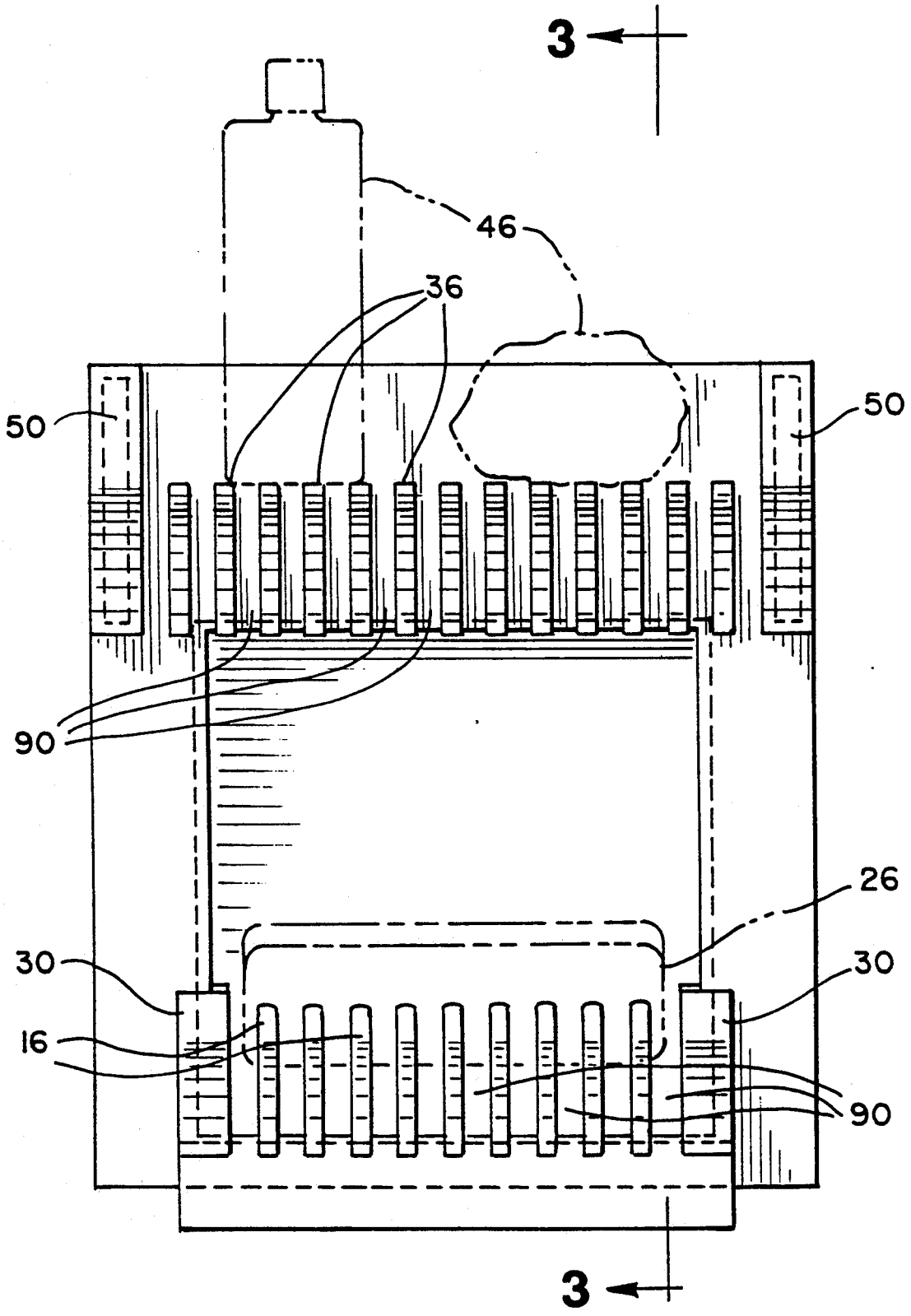
FIG. 2 is an elevation view of the preferred embodiment of the invention showing the rounded upper surfaces of the ribs of the soap holder and the flat upper surfaces of the ribs of the utility shelf.
Figure 3:
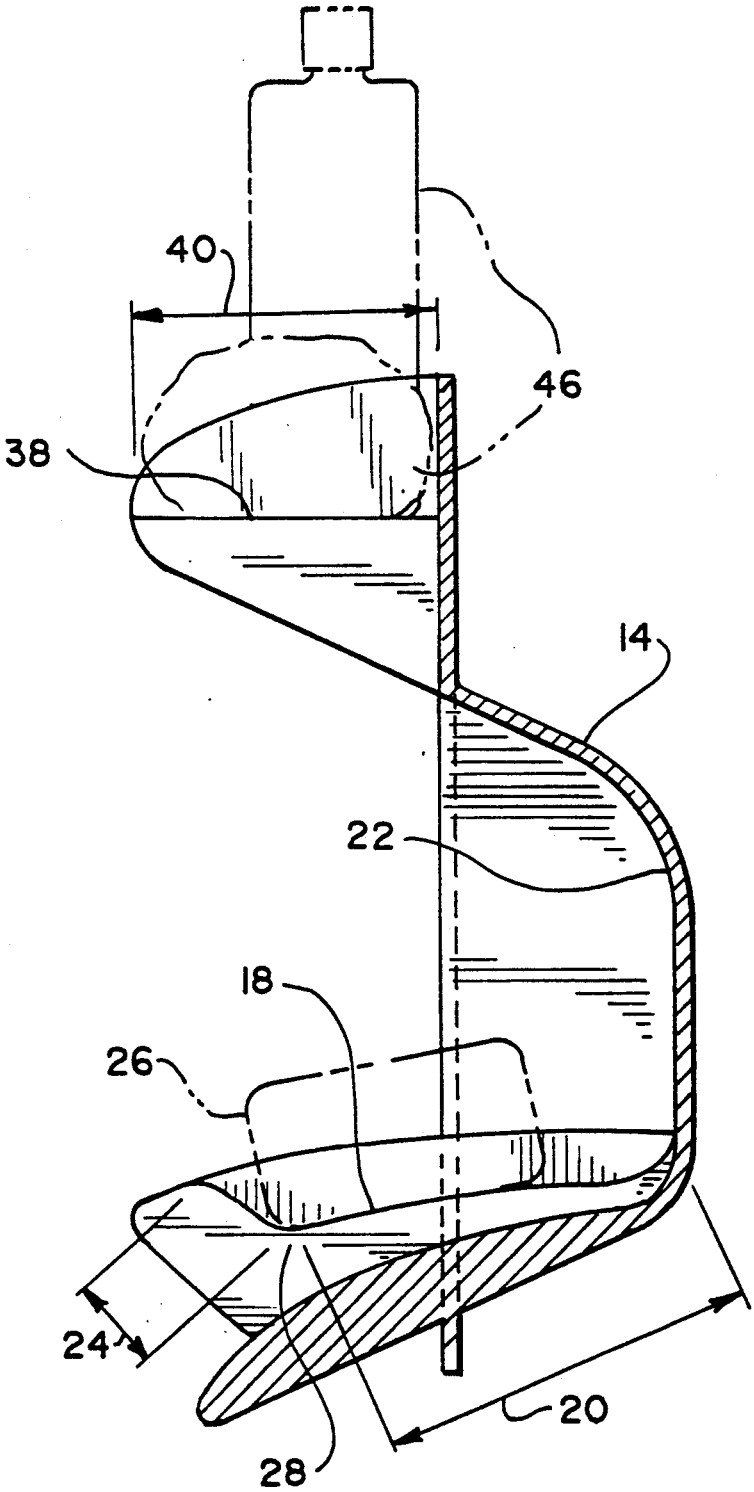
FIG. 3 is a cross-sectional view of the preferred embodiment showing the shape of the soap holder.

FIG. 1 is a perspective view of the preferred embodiment of the combination soap holder and utility shelf; FIG. 2 is an elevation view of the invention of FIG. 1; FIG. 3 is a cross-sectional view of the invention taken along section lines 3—3 of FIG. 2. In FIGS. 1-3, a soap holder 10 is combined with a utility shelf 12 in a recessed-type bath fixture housing 14.

The soap holder 10 comprises a plurality of soap holder supporting ribs 16 disposed substantially parallel to each other to form a soap holder surface 18. Each of the soap holder supporting ribs 16 includes a downward sloping portion 20 extending forward from the back wall 22 of the bath fixture housing 14, and a shorter upward sloping portion 24 located at the forward edge 22 of the soap holder surface 18. The plurality of downward sloping portions 20 and the plurality of upward sloping portions 24 meet at the forward edge 28 and enable a bar of soap 26 to be positioned securely near the forward edge 28 of the soap holder 10 while allowing the soap 26 to be easily grasped and retrieved in a single continuous motion without being lifted.

In the preferred embodiment, the soap-holder supporting ribs 16 are rounded to reduce adhesion and friction between the soap 26 and the soap-holder surface 18 and to facilitate the drainage of excess water and soap residue. Exterior ribs 30 flank the plurality of soap-holder supporting ribs 16. The exterior ribs 30 are petal-shaped and raised above the soap-holder supporting ribs 16 sufficiently to prevent a bar of soap 26 from sliding off the soap-holder surface 18 in a lateral direction.

A typical bar of soap is approximately 4¼ inches in length. In order to provide a good fit for the soap, the embodiment depicted in FIGS. 1-3 includes nine soap-holder supporting ribs 16 and two exterior ribs 30. The ribs 30 are separated by ten ¼-inch spaces 90. Each soap-holder supporting rib 16 is about ¼ inch thick and each exterior rib 30 is about ½ inch thick. The soap holder 10 may include an adjustment in the number or the thickness of the soap-holder supporting ribs 16 to provide a proper fit for a larger or smaller bar of soap while remaining sufficiently apart to allow excess water and soap residue to drain. Although the spaces 90 are typically ⅛ inch to ¾ inch, they may be as little as 1/32 inch or as much as 3-¾ inches wide.

The utility shelf 12 comprises a plurality of utility shelf supporting ribs 36 disposed substantially parallel to each other to form a utility shelf surface 38. Each utility shelf supporting rib 36 extends forward horizontally from the back wall 22 of the bath fixture housing 14. The plurality of utility shelf supporting ribs 16 enable bath articles 46, such as shampoo, razors and sponges, to be positioned securely while allowing the articles 46 to be easily grasped and retrieved.

In the preferred embodiment, the utility shelf supporting ribs 36 are flat to maximize adhesion and friction between the bath articles 46 and the utility shelf surface 38. Exterior ribs 50 flank the plurality of utility shelf supporting ribs 36. The exterior ribs 50 are raised sufficiently above the utility shelf supporting ribs 36 to prevent the bath articles 46 from sliding off the utility shelf surface 38 in a lateral direction.

In order to accommodate bath articles of various sizes, the embodiment depicted in FIGS. 1-3 includes thirteen utility shelf supporting ribs 36 and two exterior ribs 50. The ribs are separated by fourteen ¼-inch spaces 90. Each utility shelf supporting rib 36 is about ¼ inch thick and each exterior rib 50 is about ½ inch thick. The utility shelf 12 may include an adjustment in the number or the thickness of the utility shelf supporting ribs 36 to provide a proper fit for selected bath articles while remaining sufficiently apart to allow excess water and residue to drain. Although the spaces 90 are typically ⅛ inch to ¾ inch, they may be as little as 1/32 inch or as much as 1¾ inch wide.

Figure 4:
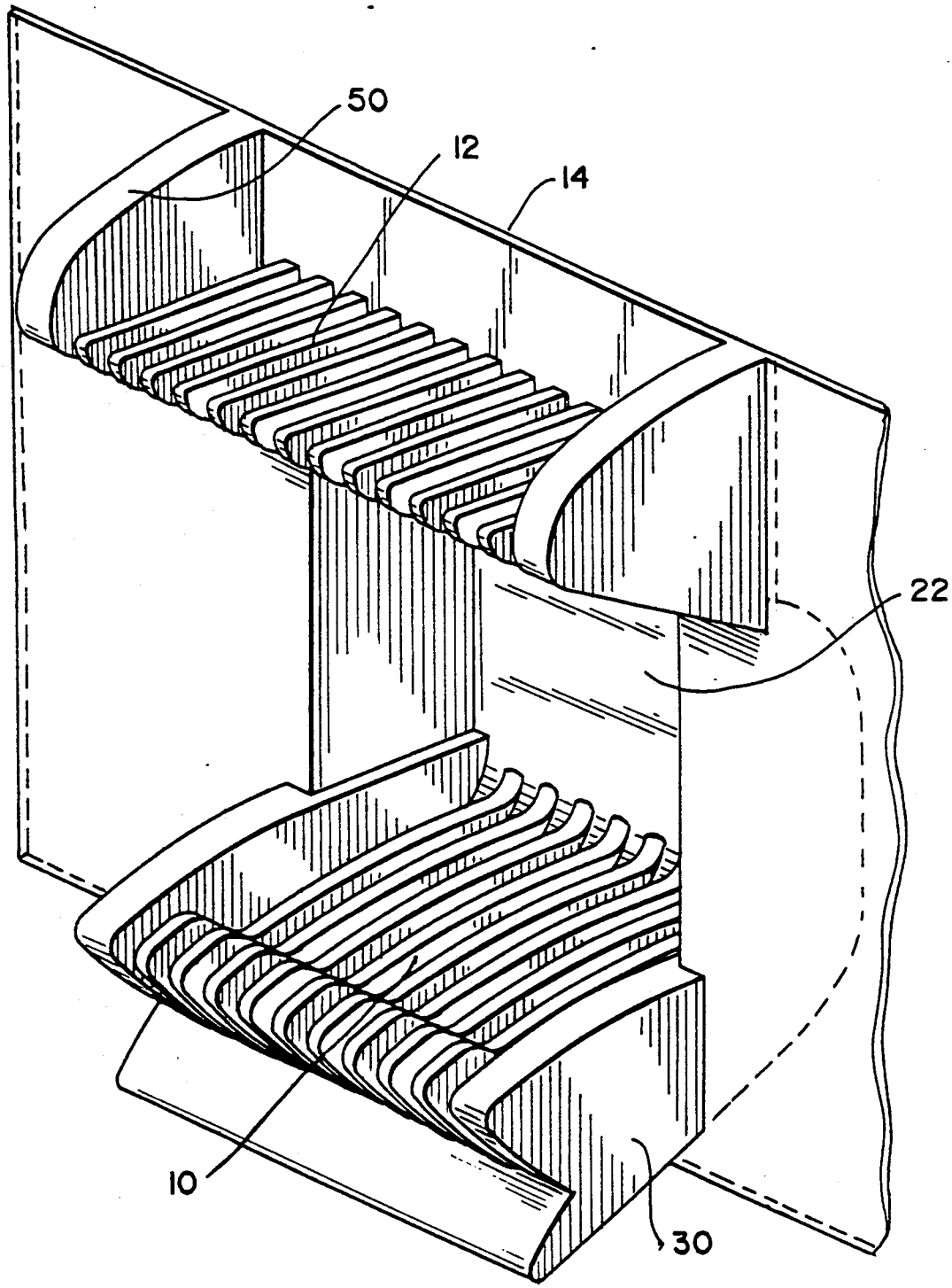
FIG. 4 is a perspective view of an alternative embodiment of the combination soap holder and utility shelf integrally molded with a pre fabricated bath or shower enclosure.
Figure 5:
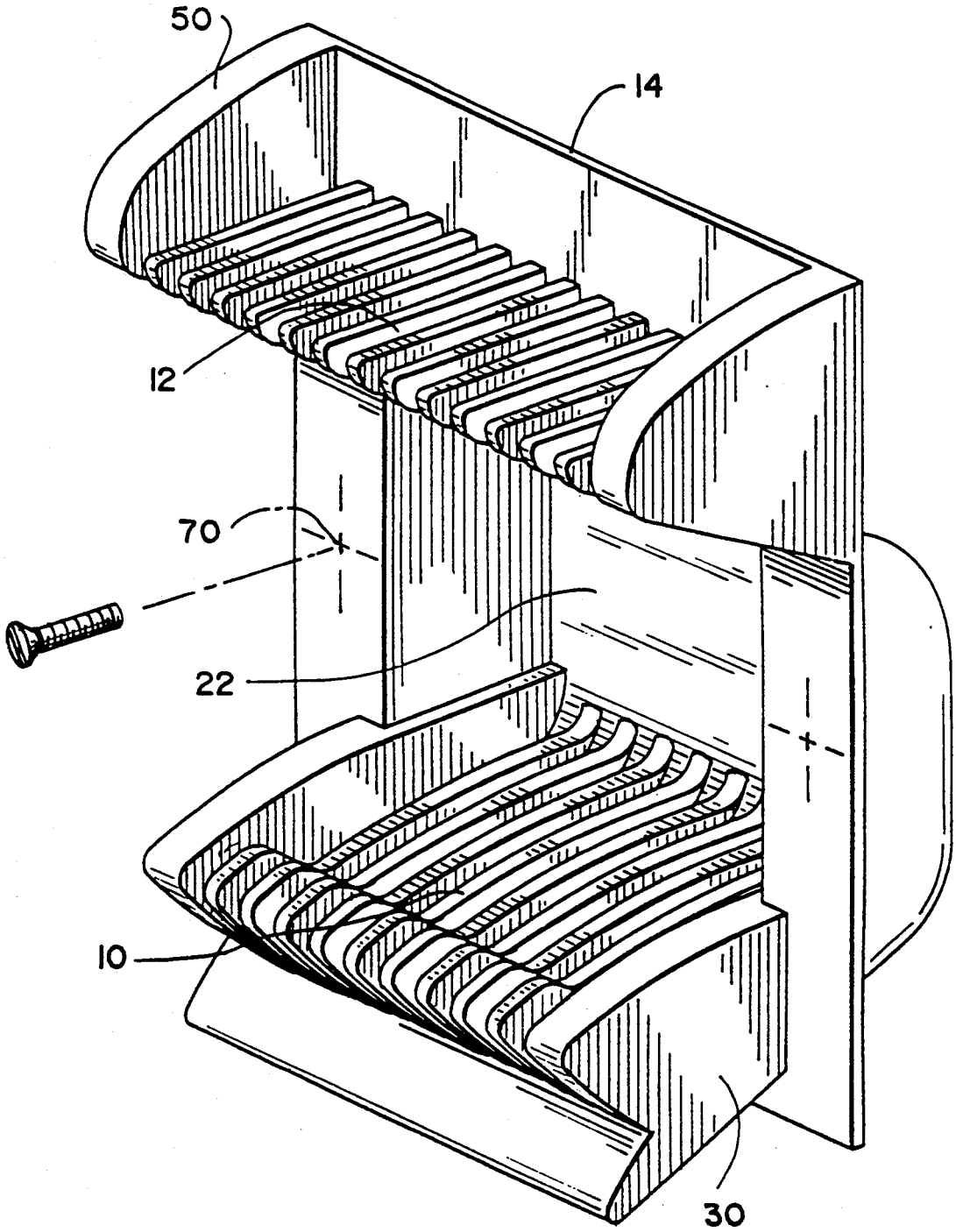
FIG. 5 is a perspective view of an alternative embodiment of the combination soap holder and utility shelf flush-mounted to an existing bath or shower wall.

The soap holder 10, utility shelf 12, and bath fixture housing 14 may be formed of, among other materials, acrylic plastic, ceramic, plastic, fiberglass, metal, or chrome-plated metal. In the preferred embodiment, shown in FIGS. 1-3, the bath fixture housing 14 is mounted to a bath or shower wall with glue, cement, or other adhesive. FIG. 4 is a perspective view of an alternative embodiment in which the bath fixture housing 14 is integrally molded with the bath or shower enclosure. FIG. 5 is a perspective view of an alternative embodiment in which the bath fixture housing 14 is flush-mounted to the bath or shower wall. As shown in FIG. 5, a plurality of mounting holes 70 may be formed in the bath fixture housing 14 into which screws or other mechanical fasteners may be inserted as a means for attaching the bath fixture housing 14 to the wall. Alternatively, the mounting holes 70 may be eliminated and the bath fixture housing 14 may be made out of ceramic tiles and installed as part of a bath or shower tile arrangement.

Figure 6:
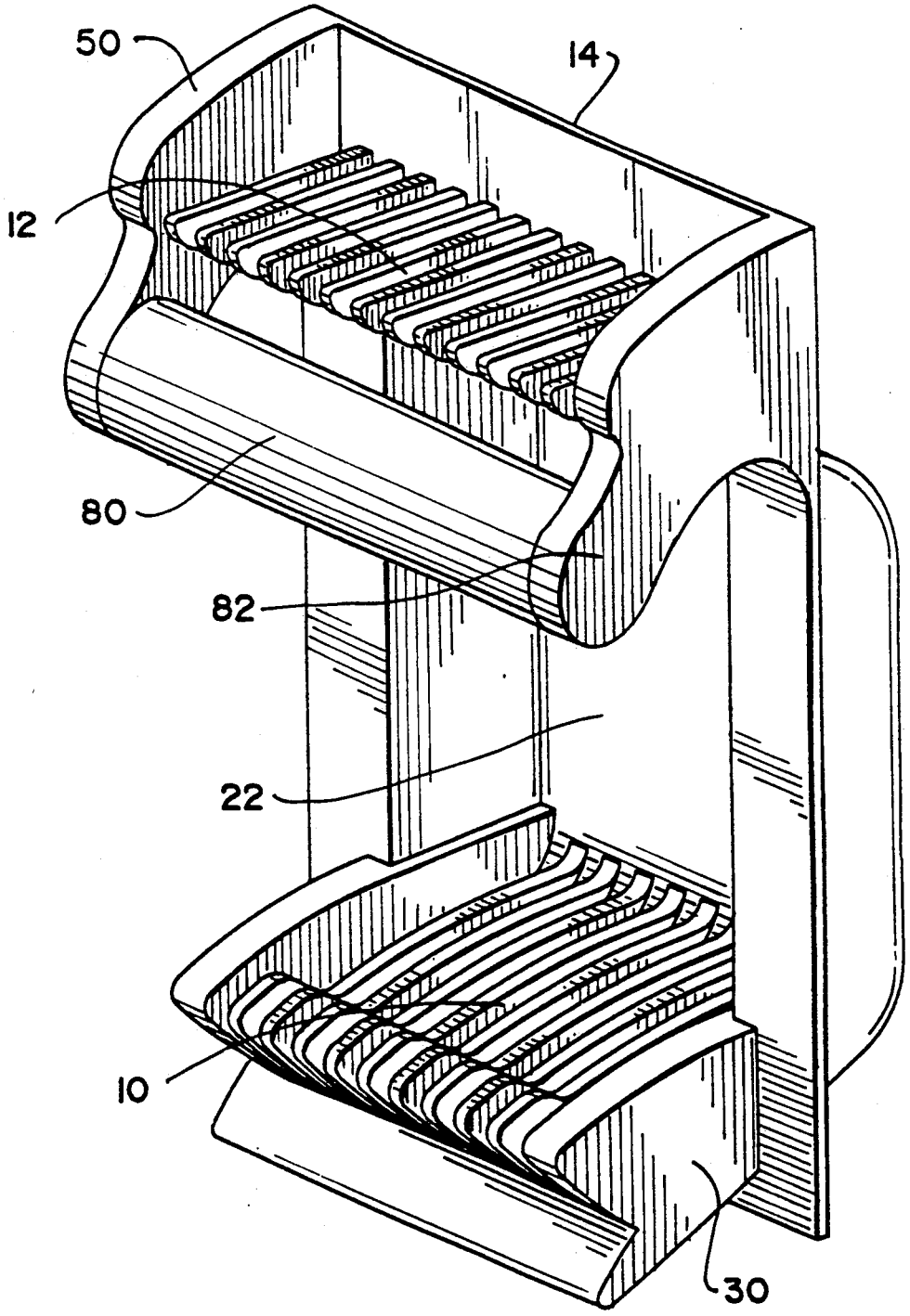
FIG. 6 is a perspective view of an alternative embodiment of the invention in which a standard U-shaped grab bar is included.

FIG. 6 is a perspective view of an alternative embodiment in which the preferred embodiment shown in FIGS. 1-3 includes a standard U-shaped grab bar 80. The U-shaped grab bar 80 is of the design customarily used in conventional bath fixtures and comprises flanges which are contoured to match the molded shape of the bath fixture housing 14.

Figure 7:
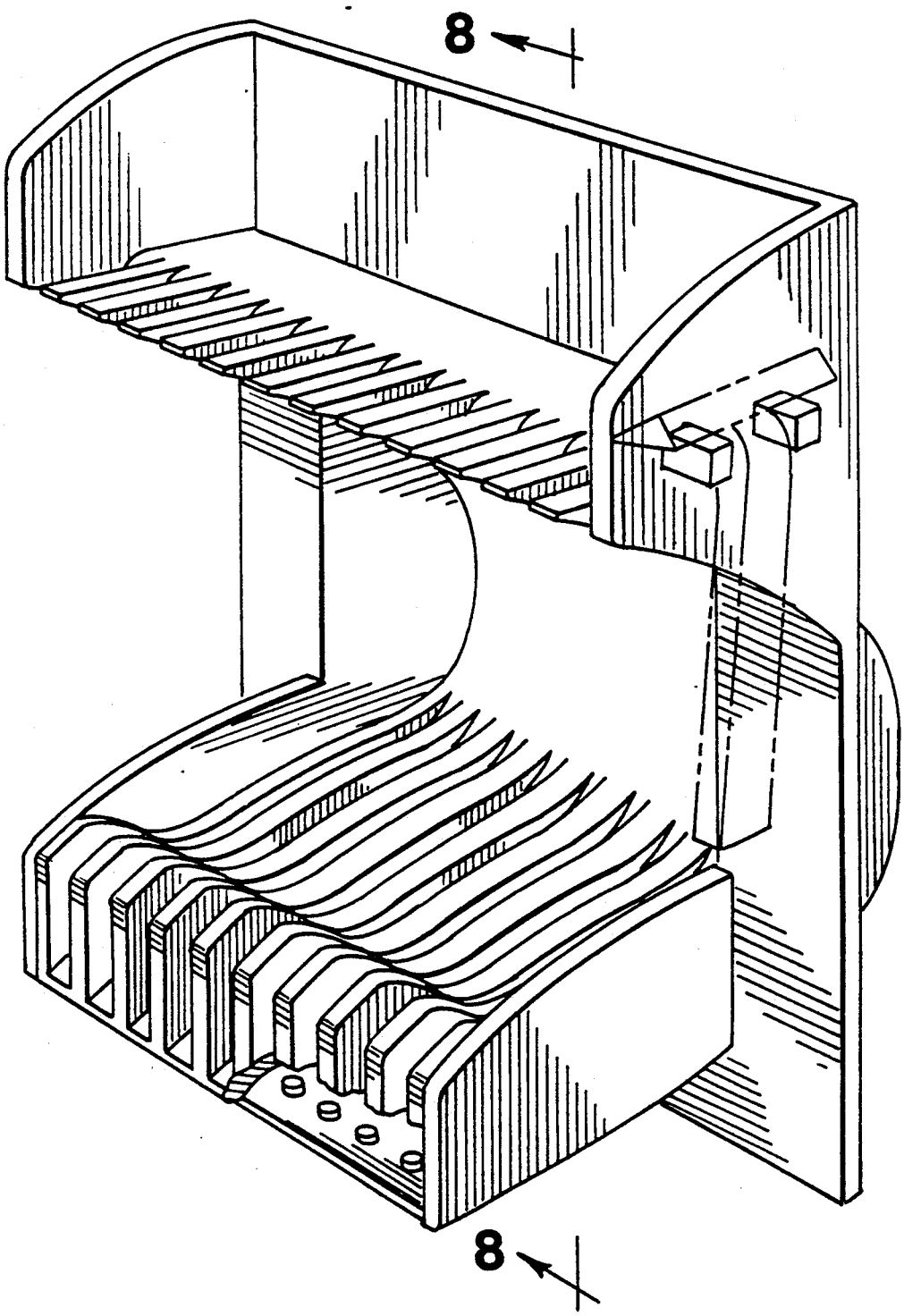
FIG. 7 is a perspective view of an alternate embodiment of the invention.

FIG. 7 is a perspective view of an alternate embodiment of the invention, and FIG. 8 is a sectional side view of the embodiment of FIG. 7 taken along section lines 8—8 of FIG. 7. In FIGS. 7 and 8, a soap holder 110 comprises a plurality of soap holder supporting ribs 116 disposed substantially parallel to each other to form a soap holder surface 118. Each of the soap holder supporting ribs 116 includes a downward sloping portion 120 extending forward from the back wall 122 of the bath fixture housing 114 and a shorter upward sloping portion 120 located at the forward edge 128 of the soap holder surface 118. The plurality of downward sloping portions 120 and the plurality of upward sloping portions 124 meet at the forward edge 128 and enable a bar of soap (not shown here) to be positioned securely near the forward edge 128 of the soap holder 110 while allowing the soap to be easily grasped and retrieved in a single continuous motion without being lifted.

In the embodiment of FIGS. 7 and 8, the soap-holder supporting ribs 116 are rounded to reduce adhesion and friction between the soap 126 and the soap-holder surface 118 and to facilitate the drainage of excess water and soap residue. Exterior ribs 130 flank the plurality of soap-holder supporting ribs 116. The exterior ribs 130 are petal-shaped and raised above the soap-holder supporting ribs 116 sufficiently to prevent a bar of soap from sliding off the soap-holder surface 118 laterally. In order to make it easier to clean the soap holder 110, the ribs 118 are attached to a removable plate 220 that is held in place by a plurality of pins 222 placed to engage corresponding detents 224. The plate 220 can be held under a running faucet to wash it.

In order to provide a good fit for the typical bar of soap, the embodiment of FIGS. 7 and 8 includes nine soap-holder supporting ribs 116 and two exterior ribs 130. The ribs 130 are separated by ten ¼-inch spaces 190. Each rib 116 is about ¼ inch thick and each rib 130 is about ½ inch thick. The soap holder 110 may have different numbers or thicknesses of the soap-holder supporting ribs 116 to fit a larger or smaller bar of soap while remaining far enough apart to let excess water and soap residue drain. Although the spaces 190 are typically ⅛ inch to ¾ inch, they may be as little as 1/32 inch or as much as 3¾ inch wide.

The utility shelf 112 comprises a plurality of utility shelf supporting ribs 136 disposed substantially parallel to each other to form a utility shelf surface 138. Each utility shelf supporting rib 136 extends forward horizontally from the back wall 122 of the bath fixture housing 114. The plurality of utility shelf supporting ribs 136 enable bath articles 146, such as shampoo, razors and sponges, to be positioned securely while allowing the article 146 to be easily grasped and retrieved. In the alternative, a razor holder 210 may be used to support a razor 212, which is shown here in phantom.

In the embodiment of FIGS. 7 and 8, the utility shelf supporting ribs 136 are flat to maximize adhesion and friction between the bath articles 146 and the utility shelf surface 138. Exterior ribs 150 flank the utility shelf supporting ribs 136. The exterior ribs 150 are raised far enough above the utility shelf supporting ribs 136 to prevent the bath articles 146 from sliding off the utility shelf surface 138 laterally.

In order to accommodate bath articles of various sizes, as in FIGS. 1-3, the embodiment of FIGS. 7 and 8 includes thirteen utility shelf supporting ribs 136 and two exterior ribs 150. The ribs 150 are separated by fourteen ¼-inch spaces 190. Each utility shelf supporting rib 136 is about ¼ inch thick and each exterior rib 150 is about ½ inch thick. The utility shelf 112 may vary in the number or the thickness of the utility shelf supporting ribs 136 to provide a proper fit for selected bath articles while remaining sufficiently apart to allow excess water and residue to drain.

FIG. 9 is an alternate sectional side view of the embodiment of FIG. 7 that is designed for deeper installation in a wall. While the soap holder 110 of FIGS. 7 and 8 is typically designed to protrude about 1½ inches into a wall, corresponding to the space left by a rafter made of two-by-four lumber, the soap holder 210 of FIG. 9 protrudes farther into the wall, typically 2 to 3 inches or whatever space is clear for the installation. This allows the soap dish 210 to stick out less, making it somewhat safer in a bathtub.

The description of specific embodiments of the present invention is intended to set forth the best mode known to the inventor for the practice of the invention. It should be taken as illustrative and not as limiting, and the scope of the invention should be limited only by the appended claims.

I claim:

1. A combination soap holder and utility shelf to hold bath articles and a bar of soap for a bathtub, shower, or bathtub-shower enclosure comprising:

(a) a housing;

(b) a soap holder having a plurality of soap-holder ribs disposed substantially parallel to each other extending forward from the housing, each of the soap-holder ribs including a downward sloping portion and a shorter upward sloping portion meeting at the forward edge of the soap holder to form a soap supporting surface, thus enabling the bar of soap to be positioned securely while allowing the bar of soap to be easily grasped and retrieved in a single continuous motion without being lifted;

(c) a pair of exterior ribs flanking the soap-holder ribs and extending forward from the housing, the exterior ribs raised above the soap-holder ribs sufficiently to prevent the bar of soap from sliding off the soap-holder surface in a lateral direction;

(d) a plurality of spaces between the soap-holder ribs, the spaces separated sufficiently to allow excess water and soap residue to drain from the soap-holder ribs;

(e) a utility shelf having a plurality of supporting ribs disposed substantially parallel to each other extending forward horizontally from the housing to form a supporting surface for bath articles, thus enabling the bath articles to be positioned securely while allowing the bath articles to be easily grasped and retrieved;

(f) a pair of shelf exterior ribs flanking the utility shelf ribs and extending forward from the housing, the shelf exterior ribs raised above the utility shelf sufficiently to prevent bath articles from sliding off the utility shelf surface in a lateral direction; and (g) a plurality of spaces between the utility shelf ribs, the spaces sufficiently apart to allow excess water and residue to drain from the utility shelf.

2. The combination soap holder and utility shelf of claim 1 wherein the soap-holder ribs are rounded to reduce adhesion and friction between the soap and the soap-holder surface and to facilitate the drainage of excess water and soap residue.

3. The combination soap holder and utility shelf of claim 1 wherein the utility shelf ribs are flat to maximize adhesion and friction between the bath articles and the utility shelf surface.

4. The combination soap holder and utility shelf of claim 1 wherein the soap holder and utility shelf are made of ceramic material.

5. The combination soap holder and utility shelf of claim 1 wherein the soap holder and utility shelf are made of an acrylic plastic.

6. The combination soap holder and utility shelf of claim 1 wherein the soap holder and utility shelf are made of fiberglass material.

7. The combination soap holder and utility shelf of claim 1 wherein the soap holder and utility shelf are made of metal.

8. The combination soap holder and utility shelf of claim 1 wherein the soap holder and utility shelf are made of chrome-plated metal.

9. The combination soap holder and utility shelf of claim 1 wherein the soap-holder ribs and utility shelf ribs are spaced from approximately 1/32 inch to $3\frac{3}{4}$ inches apart.

10. The combination soap holder and utility shelf of claim 1 wherein the housing is mounted to a wall with glue, cement, or other adhesive.

11. The combination soap holder and utility shelf of claim 1 wherein the housing is integrally molded with a shower enclosure.

12. The combination soap holder and utility shelf of claim 1 wherein the housing is flush-mounted with mechanical fasteners to a bath or shower wall.

13. The combination soap holder and utility shelf of claim 12 wherein the housing is made of ceramic tiles and installed as part of a tiled bath or shower.

14. The combination soap holder and utility shelf of claim 1 wherein the housing includes a U-shaped grab bar comprising flanges contoured to match the molded shape of the housing.

15. The combination soap holder and utility shelf of claim 1 wherein the housing is sized to protrude a depth of at least $1\frac{1}{2}$ inches into a wall.

16. The combination soap holder and utility shelf of claim 1 wherein the soap-holder ribs are attached to a plate that is removable for cleaning, the plate held in place by pins in the soap holder that engage corresponding detents in the plate.

* * * * *